US008885864B2

(12) United States Patent
Andersen

(10) Patent No.: US 8,885,864 B2
(45) Date of Patent: Nov. 11, 2014

(54) HEARING AID WITH MECHANICAL SOUND GENERATING MEANS FOR FUNCTION SELECTION

(75) Inventor: Kristian Timm Andersen, Soborg (DK)

(73) Assignee: Widex A/S, Lynge (DK)

( * ) Notice: Subject to any disclaimer, the term of this patent is extended or adjusted under 35 U.S.C. 154(b) by 39 days.

(21) Appl. No.: 13/608,375

(22) Filed: Sep. 10, 2012

(65) Prior Publication Data

US 2013/0004001 A1 Jan. 3, 2013

Related U.S. Application Data

(63) Continuation-in-part of application No. PCT/EP2010/053873, filed on Mar. 25, 2010.

(51) Int. Cl.
*H04R 11/04* (2006.01)
*H04R 25/00* (2006.01)

(52) U.S. Cl.
CPC ..... *H04R 25/65* (2013.01); *H04R 2225/61* (2013.01); *H04R 25/43* (2013.01)
USPC ..... 381/361; 381/322; 381/358; 381/182

(58) Field of Classification Search
USPC ..... 381/322, 358, 182, 91, 375, 355, 369
See application file for complete search history.

(56) References Cited

U.S. PATENT DOCUMENTS

| | | | | |
|---|---|---|---|---|
| 5,288,955 | A * | 2/1994 | Staple et al. | 181/158 |
| 5,555,306 | A * | 9/1996 | Gerzon | 381/63 |
| 6,657,614 | B1 * | 12/2003 | Ito et al. | 345/168 |
| 7,995,779 | B2 * | 8/2011 | Petersen | 381/317 |

FOREIGN PATENT DOCUMENTS

| | | | |
|---|---|---|---|
| DE | 10145994 | A1 | 4/2003 |
| EP | 1235241 | B1 | 5/2007 |
| JP | 2001-16762 | A | 1/2001 |
| WO | 2005036924 | A1 | 4/2005 |

OTHER PUBLICATIONS

International Search Report with Written Opinion for PCT/EP2010/053873 dated Nov. 24, 2010.

* cited by examiner

*Primary Examiner* — Davetta W Goins
*Assistant Examiner* — Amir Etesam
(74) *Attorney, Agent, or Firm* — Sughrue Mion, PLLC

(57) ABSTRACT

A hearing aid (1) comprises a housing, two microphones (3, 4), signal processing means provided with user selectable settings, and a receiver. The housing is provided with mechanical sound generating means (5, 11). The sound generating means is capable of providing a specific sound when manipulated by a hearing aid user. The sound generating means is arranged such that the two signals (25), obtained from the specific sound being recorded by the two different microphones (3, 4) will have a negative correlation, making said specific sound identifiable by said signal processing means. The signal processing means are arranged for selecting a specific setting dependent on one or more sounds generated by the sound generating means (5, 11). The invention further provides a method for selecting a setting of a hearing aid.

14 Claims, 4 Drawing Sheets

HEARING AID WITH MECHANICAL SOUND GENERATING MEANS FOR FUNCTION SELECTION

RELATED APPLICATIONS

The present application is a continuation-in-part of application No. PCT/EP2010/053873, filed on Mar. 25, 2010, in Europe and published as WO2011/116818 A1.

BACKGROUND OF THE INVENTION

1. Field of the Invention

The present invention relates to hearing aids. The invention further relates to a hearing aid with sound generating means for function selection. The invention further relates to a method of selecting a setting of a hearing aid.

Hearing aids comprise a number of different parameters which can be adjusted to different types of listening situations relevant to the individual hearing aid user. Typically a number of programs are defined for a hearing aid. These programs comprise preselected settings of all parameters in order to optimize the listening situation in specific sound environments. The hearing aid user can then select between the programs by a switch or toggle on the hearing aid, or by the use of a remote control.

When the hearing aid comprises two microphones these programs will also include settings related to the sensitivity to sounds from different directions.

The use of sounds, generated by the hearing aid user manipulating the hearing aid in some way, for selecting a specific hearing aid program or for turning the volume up or down, makes it possible to avoid an electrical contact which takes up a significant amount of space in hearing aids. Since the trend is to make smaller and smaller hearing aids, any space which can be saved, such as space for electrical wiring for a contact, may be important.

2. The Prior Art

WO-A1-2005/036924 discloses a hearing aid where the noise from touching of the hearing aid housing is detected by the hearing aid microphones and is applied for performing changes in the signal processing in the hearing aid.

DE-A1-10145994 discloses a hearing aid having a sensor for detecting knocking or tapping. A specific pattern of tapping can be applied for selecting a specific hearing aid program.

One problem is that the sounds from touching or tapping may not be sufficiently well defined in order for the signal processing means of the hearing aid to identify these over the background noise.

SUMMARY OF THE INVENTION

The invention, in a first aspect, provides a hearing aid comprising a housing, two microphones, signal processing means provided with user selectable settings, and a receiver, wherein said housing is provided with mechanical sound generating means, said sound generating means being capable of providing a specific sound when manipulated by a hearing aid user, wherein said sound generating means is arranged such that the two signals, obtained from the specific sound being recorded by the two microphones, will have a negative correlation, making said specific sound identifiable by said signal processing means, wherein said signal processing means is arranged for selecting a specific setting dependent on one or more sounds generated by the sound generating means.

Here the sound generating means or the mechanical sound generating means is a separate component different from the receiver. Also, the sound generating means is not electrically connected with electrical circuits of the hearing aid.

The prior art hearing aids will not be able to detect a negative correlation between the sound recorded by the two microphones.

A hearing aid according to the invention solves the above problem since the sound generating means is arranged such that the two signals, obtained when the specific sound is recorded by the two different microphones, will have a negative correlation (i.e. antiphasic correlation). This can be achieved when the microphones and the sound generating means are positioned in the hearing aid, so that the sound generating means generates a signal that excites the membranes of each microphone, but with opposite signs. E.g. one microphone membrane is moved inwards while the other microphone membrane is moved outwards. Because of the opposite signs on the movement of the microphone membranes, the covariance or correlation between the microphone signals will be negative, and a simple threshold on the correlation can thus be used to detect a sound from the sound generating means.

It has been found that almost all other sounds have a positive covariance because the sound, e.g. from sources far away from the hearing aid, enters the microphones through the sound inlets. However, wind noise does not necessarily have a positive covariance because it causes turbulence around the microphones, which de-correlates the signals. Wind noise, however, is very chaotic and does not just consist of the simple high-energy peak that the sound generating means preferably generates. The sound from the sound generating means will however also be transferred to the microphones through the material of the hearing aid, and can therefore reach one microphone membrane from behind. When the sound from the sound generating means reaches one microphone membrane from behind through the material, and the other microphone membrane through the air, the correlation between the two microphone signals will be negative.

In an embodiment of a hearing aid the sound generating means is a tactile button. This enables the hearing aid user to feel in the fingers when the compression of the button is sufficient. This is relevant especially if the hearing aid is in a program where the sound recorded by the microphones is not transferred to the receiver, e.g. in a telecoil program or when streaming sound from another unit, where the hearing aid user will not hear the sound from the sound generating means through the receiver. The tactile button is also relevant if the hearing aid as an exception is not arranged at the ear, and the sound itself may not be discernible to the hearing aid user. A tactile button will further facilitate a simple button of small size capable of giving a well defined click sound.

In a further embodiment of a hearing aid the sound generating means comprises a compressible dome. The dome may be the button as such, or a further component arranged over the dome may be usable as button for compressing the dome. A dome has been found to be suitable to give a sound with a short time span but a relatively high sound pressure level. This may be referred to as a click sound. The dome may be made from a thin metallic or plastic material with good elastic characteristics.

By looking at the energy in the microphones, the sound from the sound generating means, e.g. in the form of a tactile and dome shaped button, can be recognized by a pair of simultaneous peaks of energy in the microphones from pushing the button down, followed by a duration of no peak excursions, followed by another pair of simultaneous peaks from releasing the button, followed by a period of no peak excursions. The time span between the two peaks may be analyzed for gaining further information to the signal processing means.

In an embodiment of a hearing aid the signal processing means comprises delay means in the signal path of one of the microphones for compensating any difference in the distance to the two microphones from the sound generating means. This allows the possibility of using a covariance between time-lagged versions of the microphone signals. This could be useful if, for instance, the microphones are placed with different distances to the acoustic button. Such a delay may be introduced in the signal path of one of the microphones, before the multiplication. The delay may be variable in order to be able to fine tune the delay according to the actual physical arrangement of the sound generating means, e.g. compensating any tolerances from the hearing aid production.

In a further embodiment the mechanical sound generating means is connected with cover means for covering one of the microphones during manipulating the sound generating means, in order to reduce the level of background noise to this microphone.

This could be applied for estimating the background noise, and thereby more clearly discriminating the generated sound from the background noise.

In a further embodiment the hearing aid is adapted to estimate the background noise by a low pass filtration of the energy level of the two microphones. In a further embodiment the hearing aid is adapted to compare the magnitude of a negative correlation against a preselected threshold, when the energy from the microphones is a given level above the background noise. This should reduce the risk of attributing erroneous sounds to the sound generating means.

In a further embodiment the numerical value of the negative covariance must exceed a given threshold value in order to result in selection of a specific setting.

In a second aspect the invention provides a method for selecting a specific setting of a hearing aid comprising selecting a hearing aid having a housing, two microphones, signal processing means provided with user selectable settings, and a receiver, wherein said housing is provided with mechanical sound generating means capable of providing a specific sound when manipulated by a hearing aid user, and arranged such that the two signals, obtained from the specific sound being recorded by the two microphones, will have a negative correlation, wherein said signal processing means is arranged for making the specific sound identifiable and for selecting a specific setting dependent on the specific sound; manipulating the sound generating means thereby generating said specific sound; and identifying said specific sound by the signal processing means, whereupon a specific setting of the hearing aid is selected by the signal processing means.

BRIEF DESCRIPTION OF THE DRAWINGS

Embodiments of the invention will now be explained in further detail with reference to the figures.

DETAILED DESCRIPTION OF THE DRAWINGS

Figure 1:
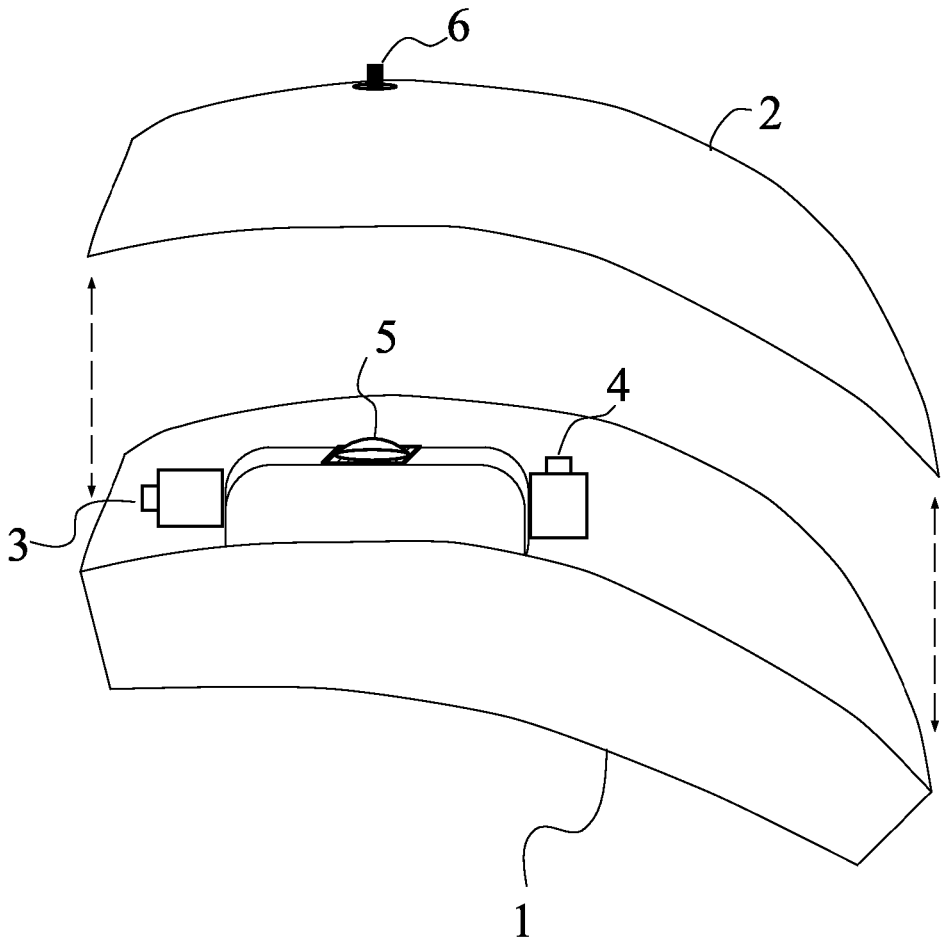
FIG. 1 illustrates a hearing aid with two microphones and mechanical sound generating means.

FIG. 1 shows a behind-the-ear hearing aid 1 with a wind shield 2 removed from the hearing aid 1. The hearing aid 1 is shown with two microphones 3, 4. One microphone 3 is pointing to the left on the figure and one microphone 4 is pointing upwards in the figure. These directions indicate the directions of the microphone openings. Between the two microphones 3, 4 a sound generating means in the form of a dome 5 is arranged, e.g. on the block 7 comprising electronic parts of the hearing aid. A button 6 is arranged in the wind shield 2 such that when the wind shield 2 is connected to the hearing aid housing, a push on the button 6 will compress the dome 5, thereby generating a characteristic sound in the form of a click. Due to the microphone openings pointing in different directions, a click will excite or move one microphone membrane inwards and the other microphone membrane outwards in relation to the microphone opening. This is due to the fact that the sound from the sound generating means is transmitted both through air and through the material of the hearing aid, e.g. through the material of the block 7. If the sound to microphone 3 is transmitted primarily through the material of the block 7 and the sound to the microphone 4 is transmitted primarily through air, the membranes will be moved in opposite directions, and thereby a negative correlation between the signals from the two microphones will be obtained.

Figure 2:
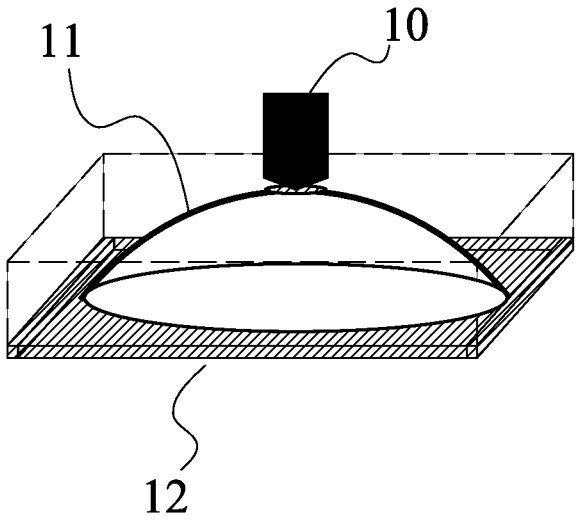
FIG. 2 illustrates an example of mechanical sound generating means in the form of a tactile button.

FIG. 2 shows a tactile button 10 which is connected to a dome 11. The dome 11 will provide a click sound when compressed. When the compressed dome 11 then is released a click sound will be generated again. Such a button will always provide the same or substantially the same sound with the same or substantially the same sound pressure, when it is compressed, and the same or substantially the same sound with the same sound pressure when released. The sound and sound pressure of the compression will not necessarily be the same as that of the release. The time lag between the compression and release of the dome may also be applied for providing specific information from the hearing aid user to the signal processing means, such as a specific program to be selected or turning the volume up or down. Also, the use of multiple compressions and releases directly following each other, or with predefined time intervals, may be applied for selecting specific programs. A button comprising a dome shaped part providing a click when compressed is also described in EP-B1-1235241 and JP-A-200116762.

A tactile button, e.g. like the one shown in FIG. 2, can be made sufficiently small, e.g. 2-3 mm in diameter to fit easily on the housing of a hearing aid. Such a button could be attached by gluing to the housing of the hearing aid, e.g. below the wind shield as shown in FIG. 1. The tactile button in FIG. 2 comprises the button part 6, 10 and the dome part 5, 11 (see also FIG. 1) making it tactile.

Figure 3:
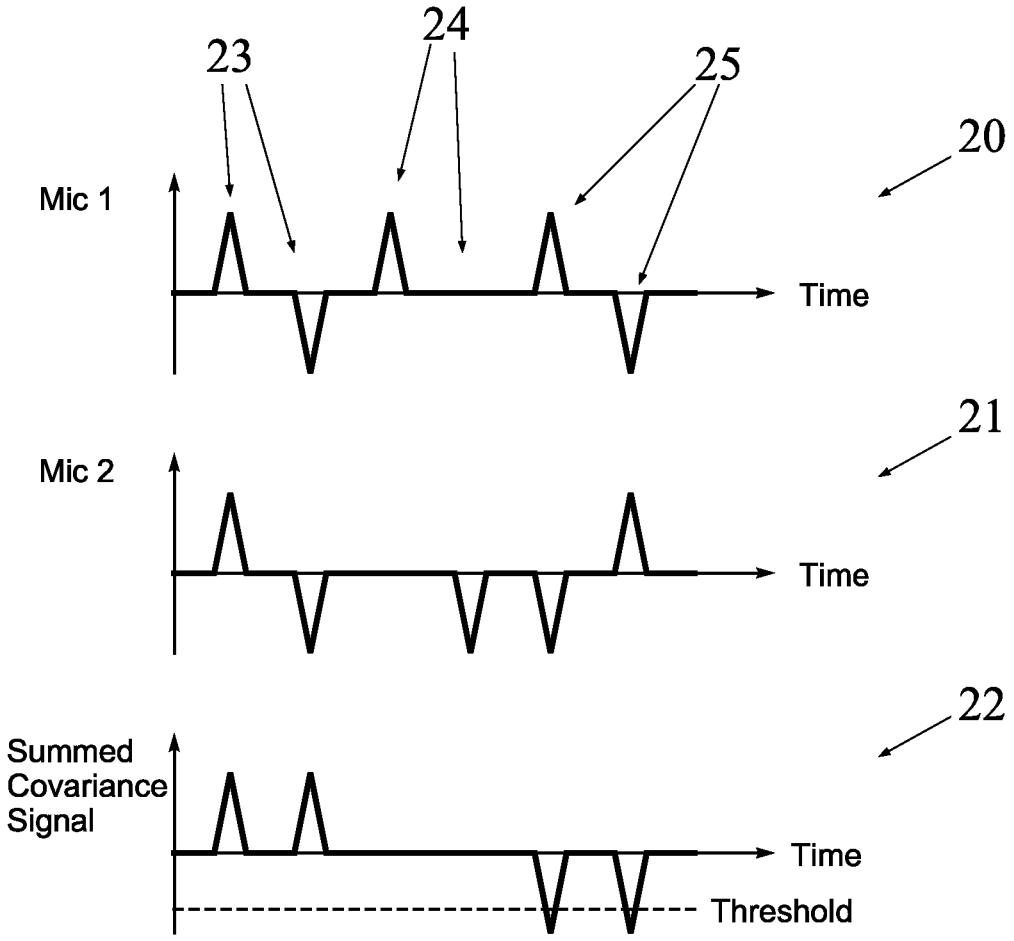
FIG. 3 illustrates examples of different types of sound recorded by the two microphones.

FIG. 3 shows the principle of how different types of sound may be recorded. Three examples of sounds are shown in FIG. 3. For each sound the resulting signal is illustrated in three different diagrams, i.e. one diagram 20, 21 for each of the two microphones (referred to as Mic1 and Mic2 in FIG. 3), and one diagram 22 illustrating the covariance. The first sound 23 is an impulsive sound from an external, far removed, sound source. Here, the signals from the two microphones will be the same, and the covariance will be positive. The second sound 24 in FIG. 3 is uncorrelated sound, such as wind noise, where the signal from the two microphones will be different and not correlated, i.e. the covariance is zero. The third sound in FIG. 3 is the sound from sound generating means, such as a button described above, where the first peak could be the compression of e.g. a dome, and the second peak could be the release, where the compressed dome jumps back to the original dome shape, resulting in a second click sound. The signals from the two microphones will be numerically the same, but will have opposite signs. The covariance will thus be negative.

Preferably, a threshold on the covariance will be applied as shown in FIG. 3 diagram 22, in order to avoid e.g. accidental wind noise being interpreted as a signal from sound generating means.

Figure 4:
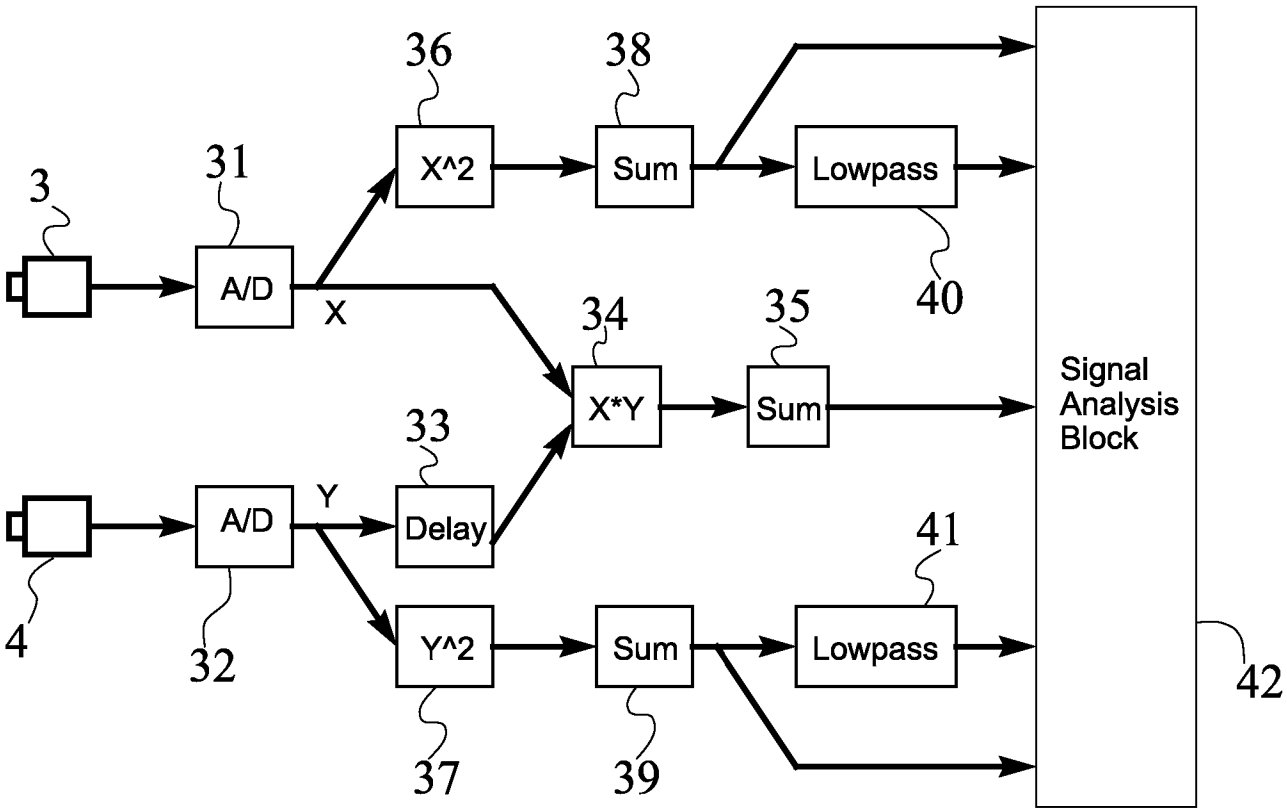
FIG. 4 illustrates in schematic form how the signals from the two microphones are analyzed.

FIG. 4 shows how the signals from the two microphones are analyzed in order to identify a signal from the signal generating means. The analysis estimates the covariance between the signals from the two microphones. The background for the estimation of the covariance is that the covariance <x,y > between the two signals from the microphones x and y can be estimated as:

$$< x, y >= \frac{1}{N}\sum_i (x_i - \mu_x)\cdot(y_i - \mu_y)$$

where i is the time index, N is the number of samples the covariance is estimated over, and $\mu_x$ and $\mu_y$ is the mean value of x and y, respectively. As the mean in a sound signal is assumed to be zero and N is a constant, which means it can be ignored since only relative values are relevant, the covariance estimation can be reduced to:

$$< x, y >= \sum_i x_i \cdot y_i$$

The energy <x > of a signal is estimated as:

$$< x >= \frac{1}{N}\sum_i x_i^2$$

where i is the time index and N is the number of samples the energy is estimated over. Again N is a constant, which can be ignored since only relative values of the energy are relevant:

$$< x >= \sum_i x_i^2$$

In FIG. 4 the signals from each of the two microphones 3, 4 are digitized in the two analogue to digital converters 31, 32. The product of the two signals x and y is calculated as illustrated by the x*y box 34. A variable delay 33 is applied for compensating for any difference in physical distance from the sound generating means 5 to each of the two microphones 3, 4. The delay 33 should be adjusted so that samples of the x and y signal that are simultaneous in time are multiplied in the x*y box 34. These multiplied simultaneous samples of x and y are summed in overlapping blocks in box 35. This results in an estimated value of the covariance as shown above. This is also the covariance indicated in the diagram 22 in FIG. 3.

The energy of the signal x from the microphone 3 is estimated by the square of x in the x^2 box 36 which is summed in overlapping time blocks in box 38. The length of the block being summed is shorter than the expected duration of the sound, e.g. a clicking sound, from the sound generating means. The summed value of x squared is transferred directly to the signal analysis block 42, and is also transferred through a low pass filter 40 to the signal analysis block 42. The low pass filtered signal provides the energy level of the background noise, whereas the non low pass filtered signal provides the energy level of the background noise with the sound peak added.

The energy of the signal y from the microphone 4 is estimated in an equivalent way in the blocks 37, 39, 41. The square of y is calculated in the y^2 box 37 which is summed in overlapping blocks in box 39. The summed value of y squared is transferred directly to the signal analysis block 42, and is also transferred through a low pass filter 41.

The energy of the x and the y signal may be used for identifying true sounds from the sound generating means. As the signal from the sound generating means, e.g. click from a button, is known beforehand, the energy of each microphone can be compared to the sound generating means signal, for instance by a threshold. By checking the energy level against the low passed version of the energy signal, erroneous peaks from background noise can be discarded.

I claim:

1. A hearing aid comprising a housing, two microphones, a signal processor provided with user selectable settings, and a receiver, wherein said housing is provided with mechanical sound generator capable of providing a specific sound when manipulated by a hearing aid user, wherein said sound generator is arranged such that the two signals, obtained from the specific sound being recorded by the two microphones, will have a negative correlation, making said specific sound identifiable by said signal processor, wherein said signal processor is arranged for selecting a specific setting dependent on one or more sounds generated by the sound generator.

2. The hearing aid according to claim 1, wherein said sound generator is a tactile button.

3. The hearing aid according to claim 1, wherein said sound generator comprises a compressible dome.

4. The hearing aid according to claim 1, wherein said signal processor comprises a delay in the signal path of one of the microphones for compensating any difference in distance to the two microphones from the sound generator.

5. The hearing aid according to claim 2, wherein a first sound is generated when pressing the button and a second sound, different from said first sound, is generated when releasing the button.

6. The hearing aid according to claim 2, wherein said mechanical sound generator is placed below a wind shield and connected with said button allowing manipulating the sound generating means from outside the wind shield.

7. The hearing aid according to claim 1, wherein the mechanical sound generator is connected with a cover for covering one of the microphones during manipulating the sound generator, in order to reduce the level of background noise to this microphone.

8. The hearing aid according to claim 1, adapted to estimate the background noise by a low pass filtration of the energy level of the two microphones.

9. The hearing aid according to claim 8, adapted to compare the magnitude of a negative correlation against a preselected threshold, when the energy from the microphones is a given level above the background noise.

10. The hearing aid according to claim 1, wherein the numerical value of the negative covariance must exceed a given threshold value in order to result in selection of a specific setting.

11. A method for selecting a specific setting of a hearing aid comprising selecting a hearing aid having a housing, two microphones, a signal processor provided with user selectable settings, and a receiver, wherein said housing is provided with mechanical sound generator capable of providing a specific sound when manipulated by a hearing aid user, and arranged such that the two signals, obtained from the specific sound being recorded by the two microphones, will have a negative correlation, wherein said signal processor is arranged for making the specific sound identifiable and for selecting a specific setting dependent on the specific sound;

manipulating the sound generator thereby generating said specific sound; and identifying said specific sound by the signal processor, whereupon a specific setting of the hearing aid is selected by the signal processor.

12. The hearing aid according to claim 1, wherein said specific setting is one of said user selectable settings.

13. The hearing aid according to claim 1, wherein said sound generator is manipulatable by said user to generate a specific sound intended by said user to cause said signal processor to adopt one of said selectable settings.

14. A hearing aid comprising a housing, two microphones, a signal processor provided with user selectable settings, and a receiver, wherein said housing is provided with mechanical sound generator which is capable of providing a specific sound when manipulated by a hearing aid user and which is arranged such that output signals from the two microphones responsive to said specific sound will have a negative correlation, whereby said specific sound is identifiable by said signal processor and said signal processor responds to said specific sound to select a specific one of said user selectable settings dependent on said specific sound.

* * * * *